US007228706B1

(12) United States Patent
Xu

(10) Patent No.: US 7,228,706 B1
(45) Date of Patent: Jun. 12, 2007

(54) EXTRACTION APPARATUS

(75) Inventor: Yonghui Xu, Oakville (CA)

(73) Assignee: National Refrigeration & Air Conditioning Canada Corp., Ontario (CA)

( * ) Notice: Subject to any disclaimer, the term of this patent is extended or adjusted under 35 U.S.C. 154(b) by 0 days.

(21) Appl. No.: 11/320,715

(22) Filed: Dec. 30, 2005

(51) Int. Cl.
*F25B 43/02* (2006.01)

(52) U.S. Cl. ..... 62/471; 62/404

(58) Field of Classification Search ..... 62/471, 62/430, 404; 165/104.17
See application file for complete search history.

(56) References Cited

U.S. PATENT DOCUMENTS

| | | | | |
|---|---|---|---|---|
| 2,328,511 | A | 8/1943 | Thomas | |
| 3,438,218 | A | 4/1969 | O'Neil | |
| 3,782,131 | A | 1/1974 | Merryfull | |
| 3,978,685 | A | 9/1976 | Taylor | |
| 4,456,437 | A | 6/1984 | Kurahayashi et al. | |
| 4,748,830 | A * | 6/1988 | Oouchi et al. | 62/476 |
| 4,916,916 | A * | 4/1990 | Fischer | 62/199 |
| 4,918,944 | A | 4/1990 | Takahashi et al. | |
| 5,255,526 | A * | 10/1993 | Fischer | 62/59 |
| 5,369,964 | A * | 12/1994 | Mauer et al. | 62/420 |
| 5,660,056 | A | 8/1997 | Arai et al. | |
| 5,996,372 | A | 12/1999 | Koda et al. | |
| 6,125,648 | A | 10/2000 | Hill | |
| 6,341,492 | B1 | 1/2002 | Carey | |
| 6,478,551 | B1 | 11/2002 | Nonaka | |
| 6,701,745 | B1 | 3/2004 | Kozinski | |

* cited by examiner

*Primary Examiner*—Melvin Jones

(57) ABSTRACT

A refrigeration system including a direct expansion evaporator with a substantially vertical header through which a fluid mixture of a refrigerant and oil is pumped, a compressor for compressing the refrigerant, and a suction tube in fluid communication with the header and the compressor through which a stream of a first fluid mixture is drawn substantially in a first direction from the header by the compressor. The first fluid mixture exerts a first fluid pressure in a second direction substantially opposite to the first direction. A second fluid mixture is located in the header and subject to a second fluid pressure substantially greater than the first fluid pressure to create a pressure differential. The system also includes an extraction apparatus with a passage subject to the pressure differential, through which passage the second fluid mixture is drawn into the suction tube.

17 Claims, 11 Drawing Sheets

Fig.1 Operating Conditions w/o Oil Pick-up
R404A, Pliq = 100±1.5 psi

Fig. 2 Operating Conditions w/ Oil Pick-up
R404A, Pliq = 101±1.5 psi

EXTRACTION APPARATUS

FIELD OF THE INVENTION

This invention is related to an extraction apparatus for use in connection with a direct expansion evaporator.

BACKGROUND OF THE INVENTION

Many different types of refrigeration units are available. As is well known in the art, in a refrigeration unit, a compressor pumps a refrigerant in a circuit to a condenser, then through an expansion valve, next to an evaporator, and then back to the compressor. Different types of evaporators are known in the art. One of the more commonly used types is the direct expansion evaporator.

Typically, lubrication oil is required to be used in the compressor. Invariably, lubrication oil from the compressor becomes mixed with the refrigerant as the refrigerant passes through the compressor. The result is that a refrigerant/oil mixture circulates through the circuit. It has been recognized that, in certain types of refrigeration units, the oil has tended to separate from the refrigerant and to accumulate in the evaporator. It is also well known that the accumulation of oil in the evaporator adversely affects the efficiency of the entire refrigeration unit. For these types of evaporators, various methods have been proposed for removal of the accumulated oil from the evaporator. For example, U.S. Pat. No. 3,782,131 (Merryfull) discloses a refrigeration unit which includes a flooded evaporator with a surge drum(s). Oil which accumulates in a lower portion of the drum is removed through an oil pick-up tube (35). However, in a "flooded" evaporator, the rate at which the refrigerant/oil mixture flows through the evaporator (and exits therefrom) is generally much lower than the flow rate of the refrigerant/oil mixture upon exiting a direct expansion evaporator.

In the prior art, it is generally thought that the rate at which the refrigerant/oil mixture flows through a header of the direct expansion evaporator (i.e., when exiting the direct expansion evaporator) is sufficient to prevent any significant accumulation of oil in the evaporator. This is because, in a direct expansion evaporator, substantially all of the refrigerant/oil mixture is vaporized at the outlet of each evaporator tube, i.e., at the intersection of each evaporator tube with the header. After discharge into the header, the refrigerant/oil mixture moves through the header and exits from the header (i.e., exits from the direct expansion evaporator) into a suction tube, which leads from the evaporator to the compressor.

Accordingly, it has generally been thought that the vaporization of substantially all of the refrigerant/oil mixture at each evaporator tube outlet in a direct expansion evaporator results in an increase in velocity of the mixture which is sufficient to prevent accumulation of oil in the evaporator. For instance, the following excerpt is from the ASHRAE Refrigeration Handbook (2002) (pp. 2.16–2.17):

> . . . flooded evaporators can promote oil contamination of the evaporator charge because they may only return dry refrigerant vapor back to system.
>
> . . . in general, direct-expansion . . . system evaporators have fewer oil return problems than do flooded system evaporators because refrigerant flows continuously at velocities high enough to sweep oil from the evaporator.

However, contrary to the generally accepted view, it has been determined that oil does accumulate in a direct expansion evaporator, as will be described.

There is therefore a need for an extraction apparatus for extracting oil which has accumulated in a direct expansion evaporator.

SUMMARY OF THE INVENTION

In its broad aspect, the invention provides a refrigeration system including a direct expansion evaporator having a plurality of evaporator tubes. Each evaporator tube provides a conduit for a fluid mixture of a refrigerant and lubrication oil. The evaporator also includes an elongate header having an internal cavity extending upwardly from a bottom end thereof. The internal cavity includes a bottom portion located at the bottom end of the header in which a second fluid mixture accumulates. The second fluid mixture is substantially static and subject to a second fluid pressure, and the second fluid mixture includes refrigerant and lubrication oil. The system also includes a compressor for compressing the refrigerant, and a suction tube in fluid communication with the header and the compressor through which a stream of a first fluid mixture of refrigerant and oil is drawn substantially in a first direction from the header by the compressor. The first fluid mixture exerts a first fluid pressure in a second direction substantially opposite to the first direction. In addition, the system includes an extraction apparatus having a body defining a passage therein extending between an upstream end thereof having an upstream hole and a downstream end thereof having a downstream hole, the downstream and upstream holes being in fluid communication through the passage. The downstream end is positioned in the suction tube and the upstream end is positioned in the bottom portion of the internal cavity and at least partially immersed in the second fluid mixture. The downstream end is positioned to direct the second fluid mixture exiting therefrom substantially in the first direction, to provide a pressure differential which draws the second fluid mixture through the passage and into the stream.

In another aspect, the invention includes an extraction apparatus for enabling a substantially static second fluid mixture positioned in a bottom portion of a header of a direct expansion evaporator and subject to a second fluid pressure to be extracted from the header and directed into a stream of a first fluid mixture drawn through a suction tube substantially in a first direction to a compressor from the header. The first fluid mixture exerts a first fluid pressure in a second direction substantially opposite to the first direction, the first fluid pressure being substantially less than the second fluid pressure to create a pressure differential therebetween. The extraction apparatus includes a body defining a passage therein extending between an upstream end and a downstream end thereof. The downstream end is positioned in the suction tube and at least partially immersed in the stream of said first fluid mixture. The upstream end is positioned in the bottom portion and at least partially immersed in said second fluid mixture, and the downstream end is positioned to expose the passage at the downstream end to the first fluid pressure so that the second fluid mixture is drawn by the pressure differential into the passage at the upstream end and discharged from the passage at the downstream end.

In yet another aspect, the invention includes a direct expansion evaporator for facilitating evaporation of a refrigerant moved in a circuit through the evaporator to a compressor through a suction tube. The compressor draws a first fluid mixture of a refrigerant and a lubrication oil through the suction tube in a first direction, with the first fluid mixture exerting a first fluid pressure in a second direction opposite to the first direction. The direct expansion evaporator includes a plurality of evaporator tubes, each evaporator tube providing a conduit for a fluid mixture of the refrigerant and lubrication oil, and an elongate header having an internal cavity extending upwardly from a bottom end thereof. Each evaporator tube intersects the header at a predetermined location along the header. The internal cavity includes a bottom portion located at the bottom end of the header in which a second fluid mixture accumulates, the second fluid mixture being substantially static and subject to a second fluid pressure. The second fluid mixture includes refrigerant and the lubrication oil. The second fluid pressure is substantially greater than the first fluid pressure. The evaporator also includes an extraction apparatus having a body defining a passage therein extending between an upstream end thereof and a downstream end thereof. The downstream end is positioned in the suction tube and at least partially immersed in the stream of the first fluid mixture, and the upstream end is positioned in the bottom portion of the internal cavity and at least partially immersed in the second fluid mixture. The downstream end is positioned to subject the passage at the downstream end to the first fluid pressure so that a pressure differential between the first fluid mixture and the second fluid mixture is provided which draws said second fluid mixture through the passage and into the suction tube.

In yet another aspect, the invention provides a refrigeration system including a direct expansion evaporator through which a fluid mixture of a refrigerant and lubrication oil is pumped. The evaporator includes a substantially vertical header. The system also includes a compressor for compressing the refrigerant and a suction tube in fluid communication with the header and the compressor through which a stream of a first fluid mixture comprising refrigerant and oil is drawn substantially in a first direction from the header by the compressor. The first fluid mixture exerts a first fluid pressure in a second direction substantially opposite to the first direction. The header includes a bottom end thereof in which a second fluid mixture comprising refrigerant and oil accumulates, the second fluid mixture being subject to a second fluid pressure. In addition, the system includes an extraction apparatus having a body defining a passage therein extending between an upstream end thereof with an upstream hole and a downstream end thereof with a downstream hole, the downstream and upstream holes being in fluid communication through the passage. The downstream end is positioned in the suction tube and the upstream end is positioned in the header and at least partially immersed in said second fluid mixture, so that the passage is subject to the second fluid pressure at the upstream end. The passage at the downstream end is at least partially exposed to the first fluid pressure to provide a pressure differential through the passage between the upstream end and the downstream end for drawing the second fluid mixture through the passage for discharge thereof at the downstream end into the suction tube.

BRIEF DESCRIPTION OF THE DRAWINGS

The invention will be better understood with reference to the drawings, in which.

DETAILED DESCRIPTION OF THE PREFERRED EMBODIMENT(S)

Figure 4:
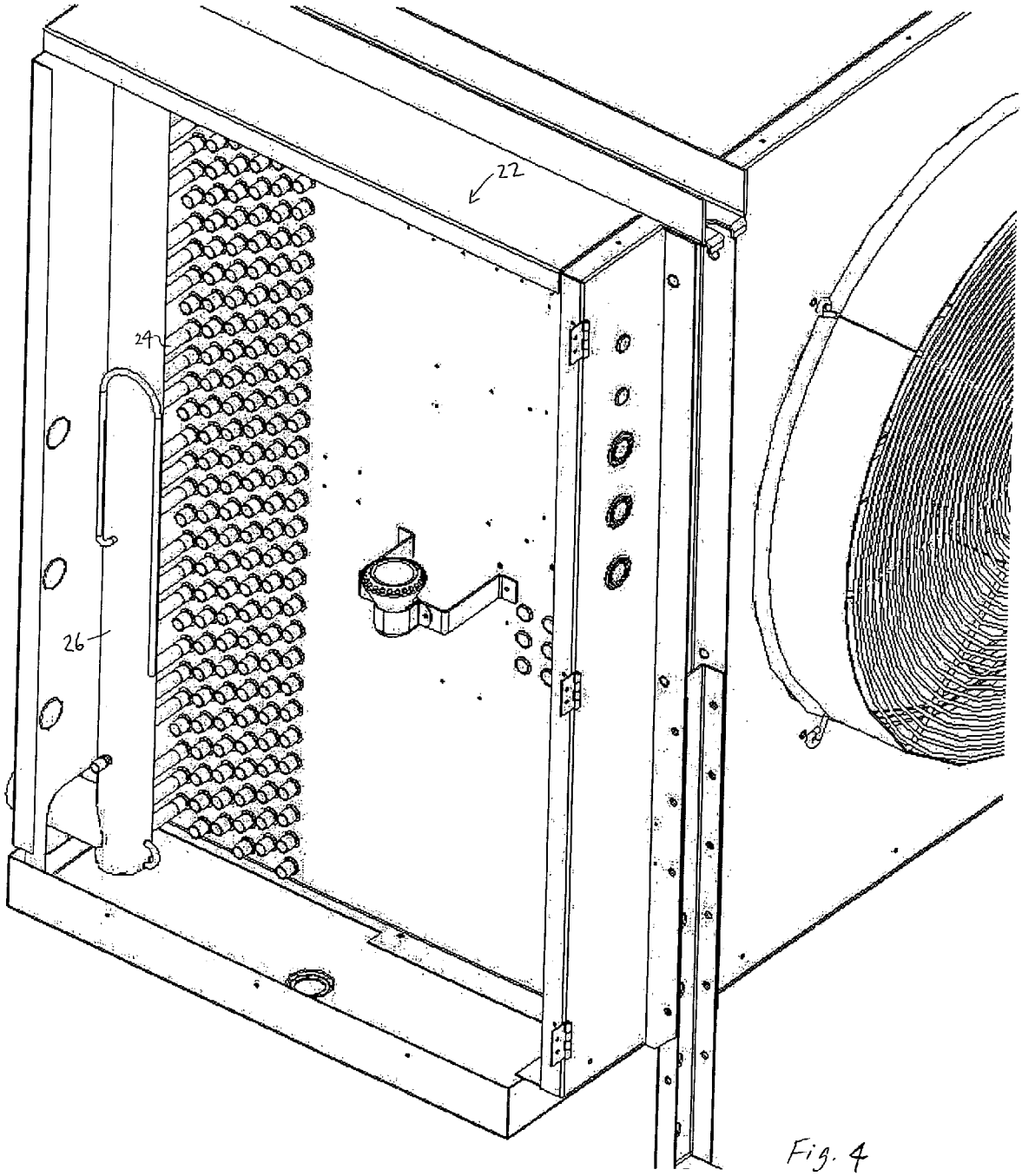
FIG. 4 is an isometric view of an embodiment of a direct expansion evaporator of the invention.
Figure 5:
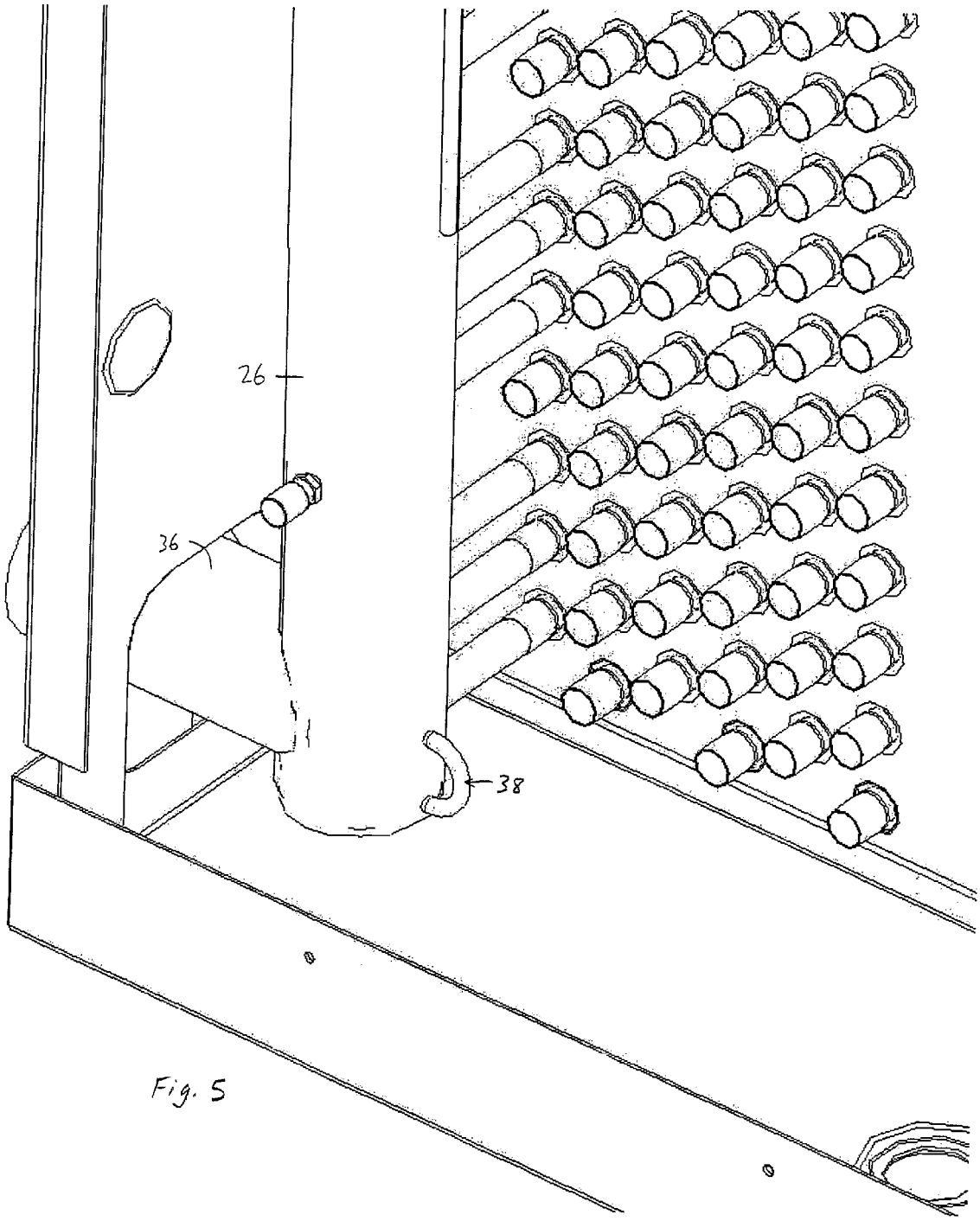
FIG. 5 is an isometric view of a bottom portion of a header of the direct expansion evaporator of FIG. 3, drawn at a larger scale.
Figure 6:
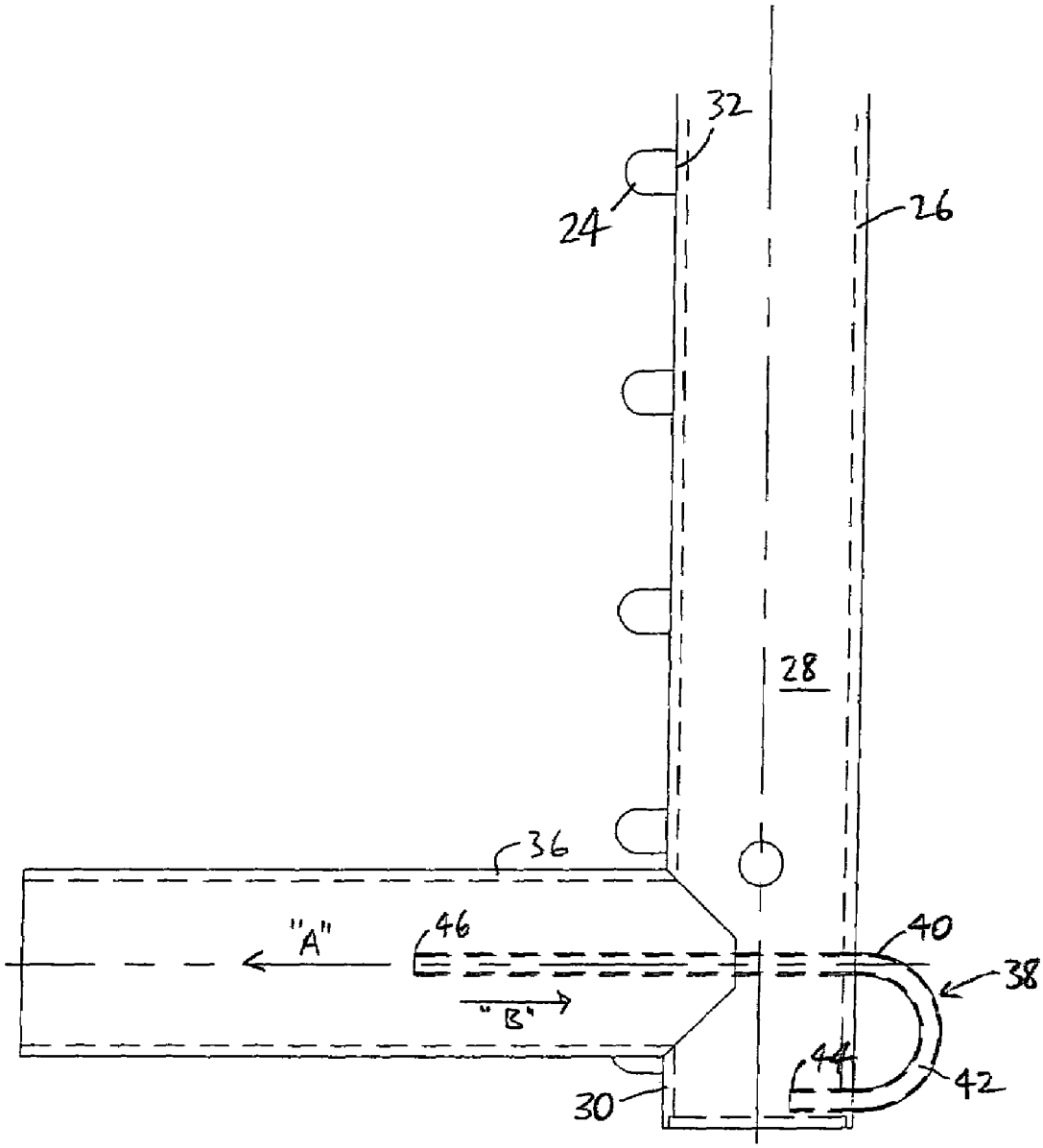
FIG. 6 is a cross-section of the header of FIG. 5 and a longitudinal cross-section of a suction pipe connected to the header and the extraction apparatus, drawn at a smaller scale.
Figure 7:
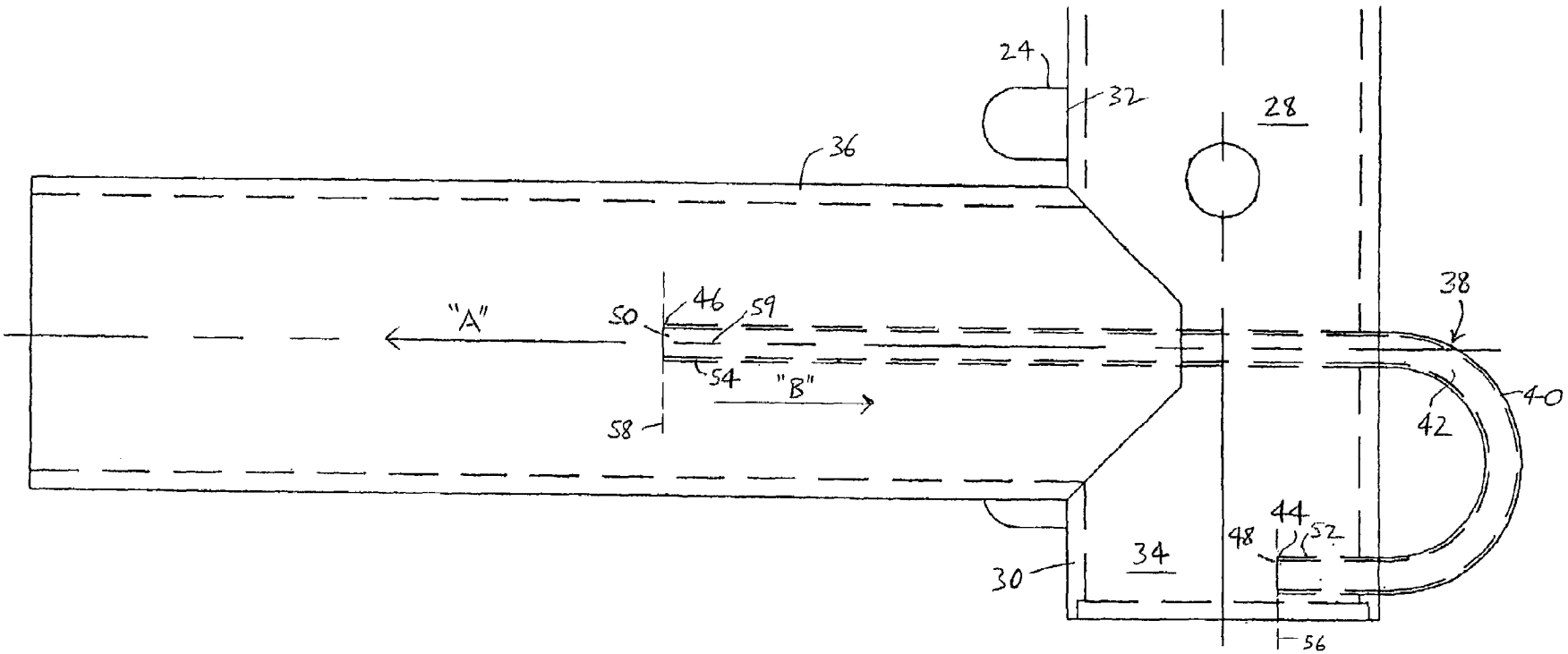
FIG. 7 is the cross-section of FIG. 6, drawn at a larger scale.
Figure 8:
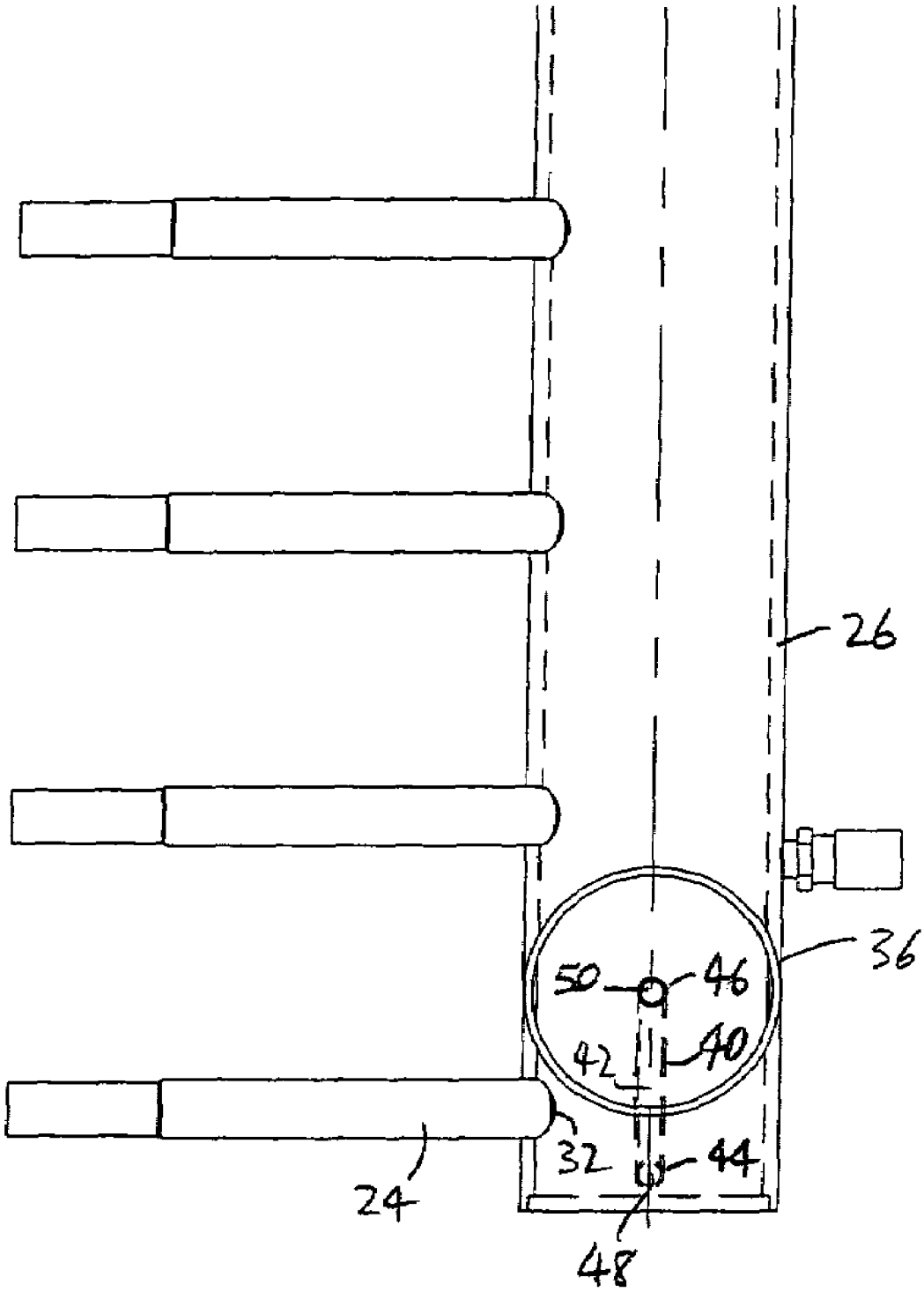
FIG. 8 is another cross-section of the header, the suction pipe, and the extraction apparatus, drawn at a smaller scale.

Reference is first made to FIGS. 2–8 to describe a preferred embodiment of a refrigeration system in accordance with the invention indicated generally by the numeral 20. The refrigeration system 20 preferably includes a direct expansion evaporator 22 which includes a number of evaporator tubes 24 providing a number of conduits for a first fluid mixture (not shown). As is known in the art, the first fluid mixture includes a refrigerant and lubrication oil. As can be seen in FIGS. 4 and 5, the direct expansion evaporator 22 preferably includes an elongate header 26 which is a substantially vertical pipe with an internal cavity 28 extending upwardly from a bottom end 30 thereof. Each evaporator tube 24 intersects the header 26 at an outlet port 32 of each tube 24 (FIGS. 6–8), so that each tube 24 intersects the header 26 along its length. As shown in FIG. 8, the internal cavity 28 includes a bottom portion 34 of the cavity 28, located at the bottom end 30 of the header 26. A second fluid mixture (not shown) accumulates in the bottom portion 34 which is substantially static and is subject to a static fluid pressure (also referred to hereinafter as a "second fluid pressure"), as will be described.

The refrigeration system 20 additionally includes a compressor 35 (FIG. 3) for compressing refrigerant and a suction tube 36 through which the first fluid mixture moves in a stream (not shown) from the direct expansion evaporator 22 to the compressor 35. The stream of the first fluid mixture is drawn substantially in a first direction (schematically illustrated by arrow "A" in FIGS. 6 and 7) from the header 26 by the compressor 35. The stream of the first fluid mixture in the suction pipe 36 exerts a fluid pressure (also referred to hereinafter as a "first fluid pressure") substantially in a second direction (schematically illustrated by arrow "B" in FIGS. 6 and 7) which is substantially opposite to the first direction.

As can be seen in FIGS. 6–8, an embodiment of the refrigeration system 20 preferably includes an extraction apparatus 38 with a body 40 defining a passage 42 therein extending between an upstream end 44 thereof and a downstream end 46 thereof. The upstream and downstream ends 44, 46 have upstream and downstream holes 48, 50 respectively. The holes 48, 50 provide for fluid communication through the passage 42 between the upstream end 44 and the downstream end 46. The downstream end 46 is preferably positioned in the suction tube 36, and the upstream end 44 is preferably positioned in the bottom portion 34 and at least partially immersed in the second fluid mixture.

Preferably, the downstream end 46 is positioned to direct the second fluid mixture exiting therefrom substantially in the first direction. The downstream end 46 is positioned to provide a pressure differential, which draws the second fluid mixture through the passage 42 and into the stream of the first fluid mixture.

The pressure differential is provided as follows. As can be seen in FIGS. 6 and 7, the downstream end 46 is positioned to expose the passage 42 at the downstream end 46 to the first fluid pressure. Due to this, and because the passage 42 is simultaneously exposed to the second fluid pressure at the upstream end 44, a pressure differential is created which draws the second fluid mixture into the passage 42 at the upstream end 44. Further, the pressure differential draws the second fluid mixture through the passage 42 to the downstream end 46, where the second fluid mixture is discharged into the stream of the first fluid mixture.

As can be seen in FIG. 7, the body 40 preferably includes an upstream end portion 52 extending from the upstream end 44 towards the downstream end 46, and a downstream end portion 54 extending from the downstream end 46 towards the upstream end 44. Preferably, each of the upstream end portion 52 and the downstream end portion 54 is generally in the form of a right circular cylinder, with the ends 44, 46 defining holes 48, 50, respectively. As shown in FIG. 7, the ends 44, 46 also define planes 56, 58, respectively. The downstream end portion 54 preferably defines a central axis 59 thereof.

Preferably, the downstream end 46 is positioned in the suction pipe 36, and is at least partially immersed in the stream of the first fluid mixture flowing through the suction pipe 36 while the system operates. Also, the upstream end 44 preferably is positioned in the bottom portion 34 and at least partially immersed in the second fluid mixture located in the bottom portion 34.

As shown in FIGS. 6 and 7, the downstream end 46 is preferably positioned so that the plane 58 is substantially orthogonal to the direction (represented by arrow "A") of the stream of the first fluid mixture, and the downstream end portion 54 is positioned so that the end 46 is substantially aligned with the direction of flow of the first fluid mixture with the hole and 50 opening towards the direction of flow. Accordingly, the pressure differential draws the second fluid mixture through the passage 42 and into the stream of the first fluid mixture.

It will be appreciated by those skilled in the art that, because of the directional aspect of the dynamic fluid pressure component of the first fluid pressure (i.e., the dynamic fluid pressure is primarily directed in the direction of the flow of the first fluid mixture through the suction pipe 36) correctly positioning the downstream end 46 of the apparatus 38 in relation to the direction of flow of the first fluid mixture has an impact on the performance of the extraction apparatus 38. For example, if the end 46 were positioned so that the hole 50 were opening towards the header 26 (i.e., in the direction opposite to the direction of flow), then the pressure exerted by the first fluid mixture directed into the hole 50 would exceed the second fluid pressure, and therefore the second fluid mixture would, in those circumstances, not be drawn into the tube 40 at the upstream end 44.

Those skilled in the art will also appreciate that the extraction apparatus 38 can function with the end 46 disposed in various positions relative to the direction of flow of the first fluid mixture, in addition to the position shown. Any such positions could be satisfactory, as long as they result in a pressure differential which is sufficient to draw the second fluid mixture through the passage 42 and into the stream of the first fluid mixture in the suction pipe 36. For instance, depending on a number of parameters (e.g., the flow rate and volume of the stream of the first fluid mixture, the amount of the second fluid pressure, and the inner diameter of the passage), the downstream end 46 could be positioned so that the central axis 59 is substantially orthogonal to the first direction. Preferably, the downstream end is positioned so that the central axis 59 is substantially aligned in the first direction (i.e., with the open end 46 directed substantially toward the first direction), the passage 42 at the downstream end 46 being exposed to the first fluid pressure. However, it is possible that the downstream end 46 could, depending on the circumstances, be positioned anywhere between the preferred position (as shown in FIG. 7) and the position in which the central axis 59 is orthogonal to the first direction.

It will also be understood by those skilled in the art that positioning the downstream end 46 to expose the passage 42 directly to the first fluid pressure is preferred because it is likely to minimize the fluid pressure in the passage at the downstream end. However, for the purposes hereof, the downstream end of the passage is considered to be exposed to the first fluid pressure whether directly so exposed (i.e., with the downstream end portion aligned substantially with the first direction, the downstream end portion being pointed in the first direction) or indirectly so exposed (i.e., with the downstream end portion positioned in any of a range of positions between substantial alignment with the first direction (as shown in FIG. 7) and being substantially orthogonal to the first direction).

In addition, those skilled in the art will appreciate that certain elements of the direct expansion evaporator have been omitted from FIGS. 4 and 5 for clarity.

Figure 1:
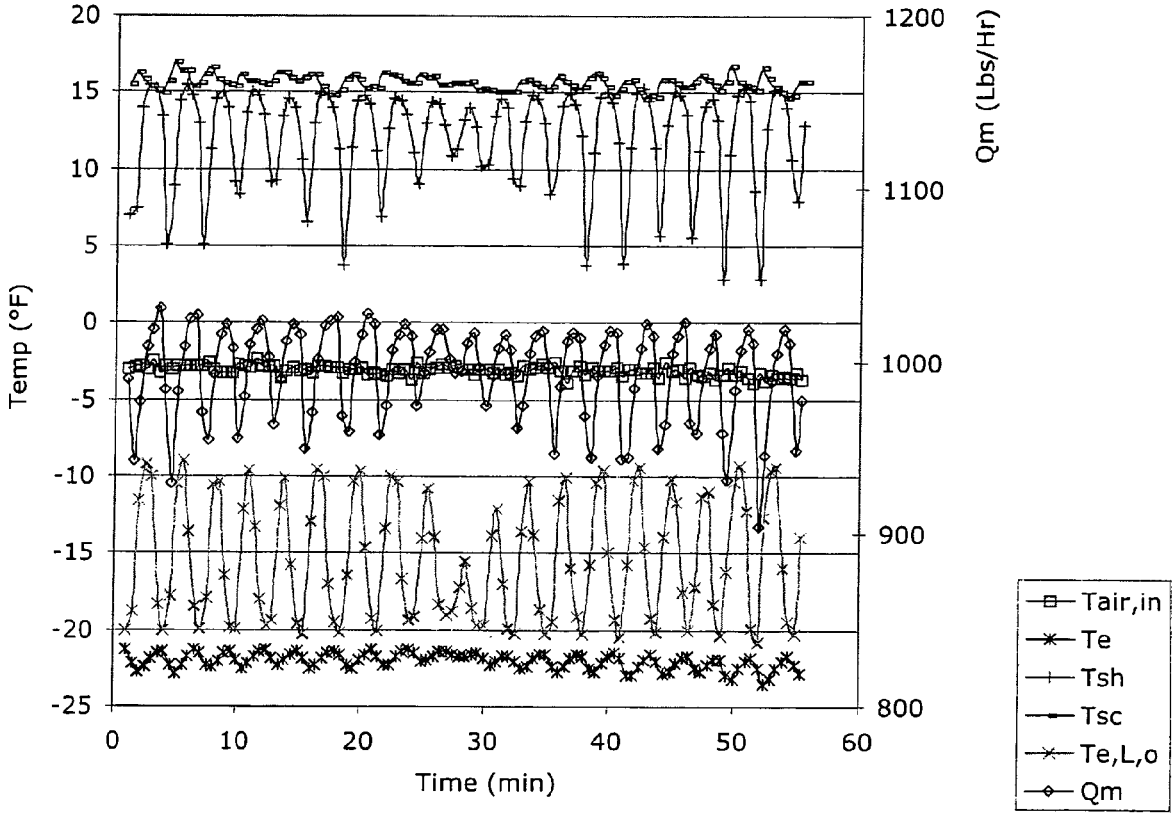
FIG. 1 is a graph showing sample test data relating to the operation of a direct expansion evaporator of the prior art.

FIG. 1 shows that, with a low-temperature direct expansion evaporator designed in accordance with ASHRAE (American Society of Heating, Refrigerating and Air-Conditioning Engineers) guidelines with respect to coil circuiting and piping sizing, oil accumulation generally occurs at the bottom of the header, even when operated at (or substantially at) design conditions. FIG. 1 shows unstable refrigerant temperature(s) at the outlet of the bottom feed (Te, L, O). The relatively low temperature(s) of the refrigerant/oil mixture at the bottom of the coil causes unstable operation of the thermal expansion valve (as indicated by the trend of the evaporator superheat Tsh), and hence instability of the mass flow of the system (Qm).

Figure 9:
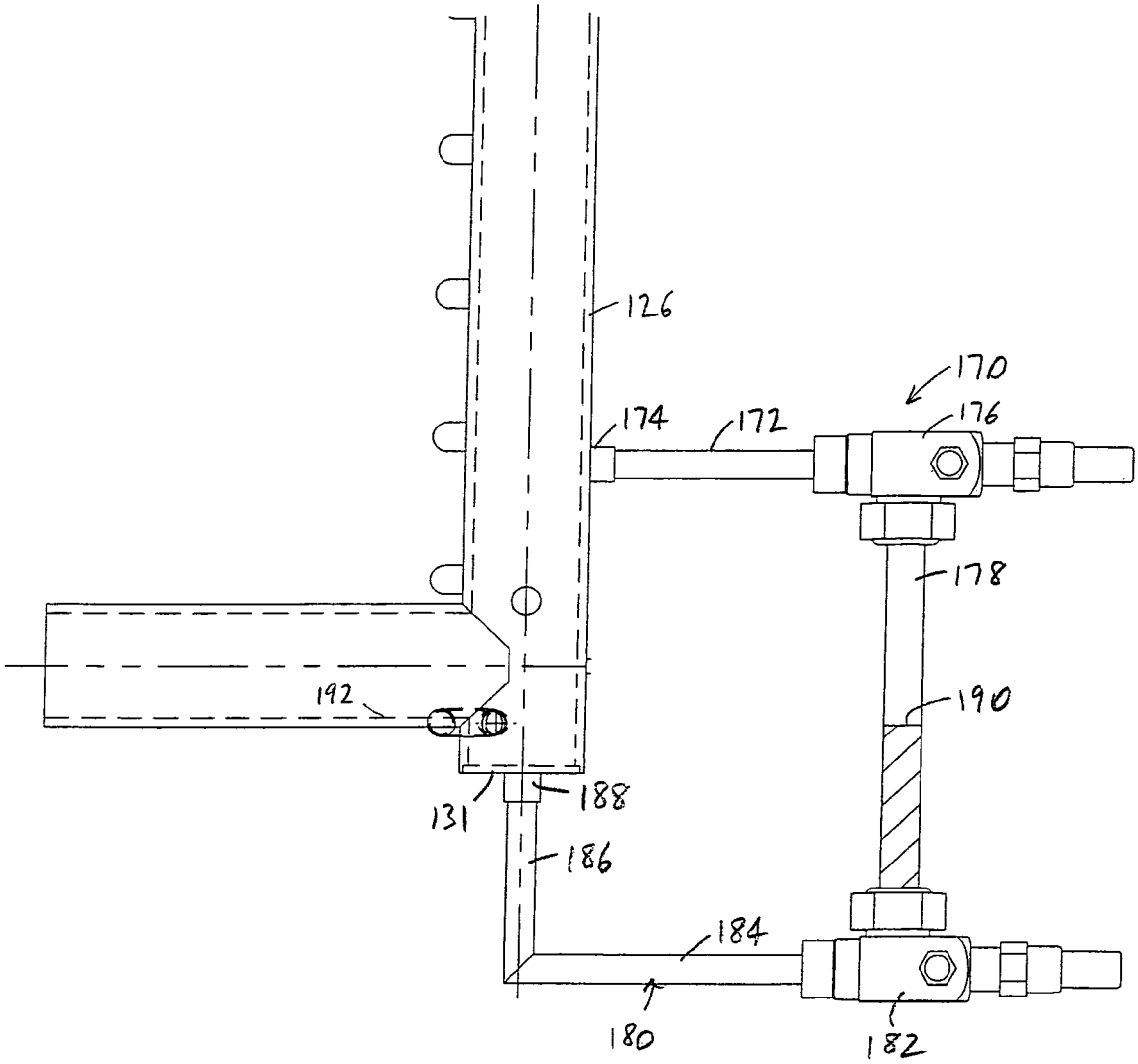
FIG. 9 is a cross-section of the header of the prior art and the suction tube shown with a bypass assembly for determining a level of oil accumulated in the header.
Figure 10:
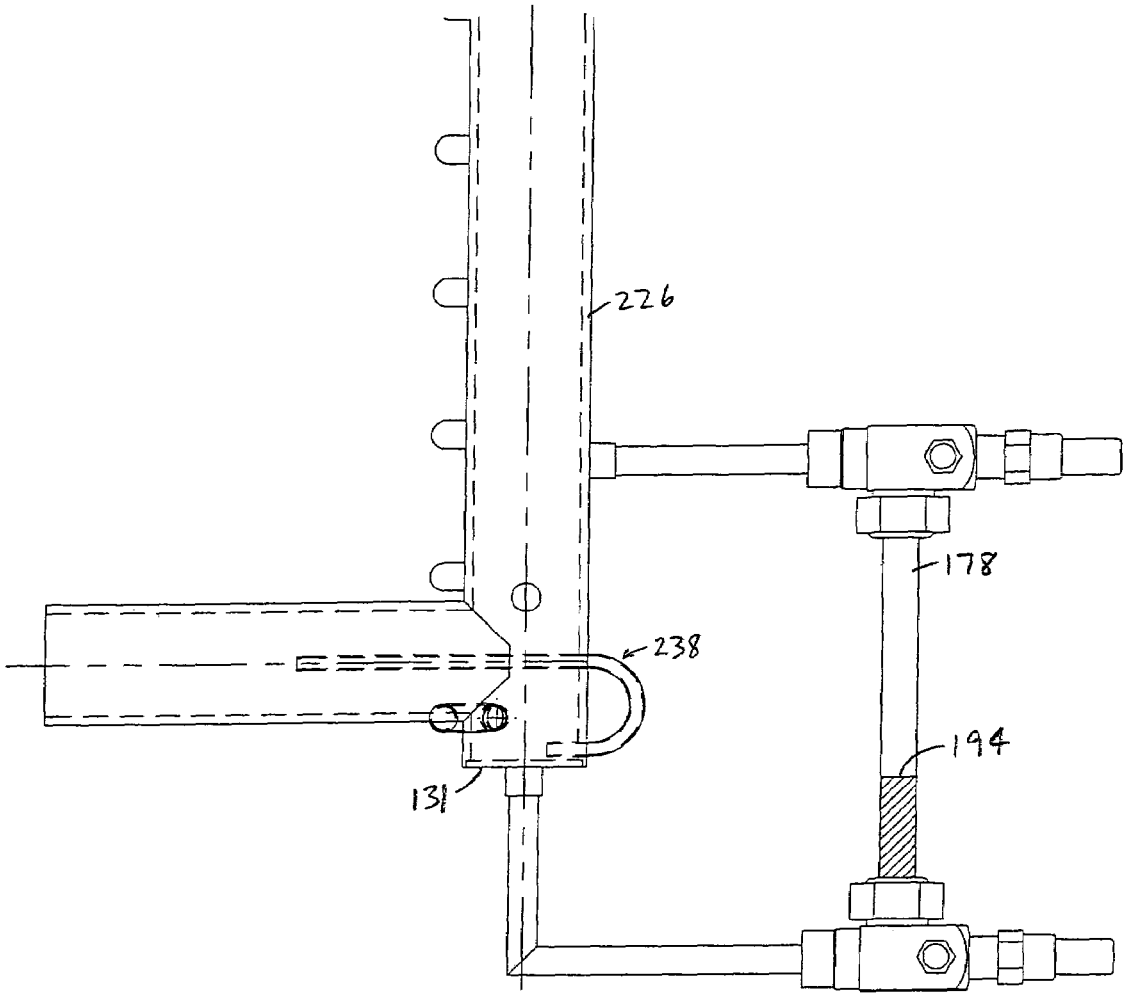
FIG. 10 is a cross-section of the header of the invention, the suction tube, and an embodiment of the extraction apparatus of the invention shown with the bypass assembly of FIG. 9 mounted on the header.
Figure 11:
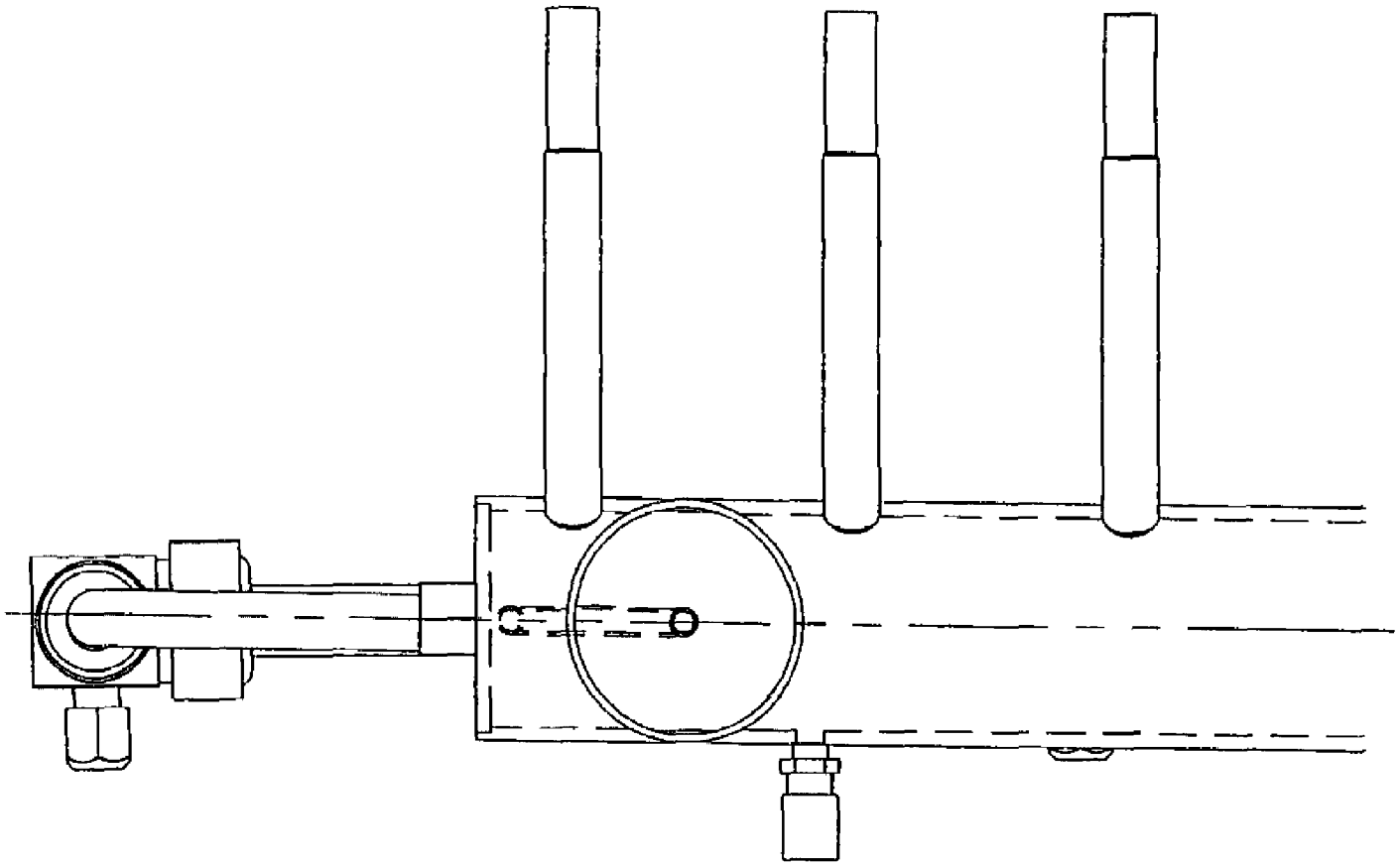
FIG. 11 is a cross-section of the header, the suction tube, the extraction apparatus, shown with the bypass assembly of FIG. 10.

Additional embodiments of the invention are shown in FIGS. 10 and 11. Also, a header of the prior art is shown in FIG. 9. In FIGS. 9–11, elements are numbered so as to correspond to like elements in FIGS. 3–8.

In order to show that oil accumulates at the bottom of the header of the prior art (i.e., a header 126 which does not include the extraction apparatus, as shown in FIG. 9), a bypass assembly 170 was mounted on the header 126. As can be seen in FIG. 9, the bypass assembly 170 includes an upper tube 172 connected to the header 126 at a connection 174, and an upper joint 176 connecting the upper tube 172 to a first vertical tube 178. The first vertical tube 178 is connected to a lower tube 180 by a lower joint 182, which are also included in the bypass assembly 170. The lower tube 180 includes a substantially horizontal portion 184 and a substantially vertical portion 186 which is connected at a lowermost end 131 of the header 126 at a connection 188.

Through the connections 174 and 188, the upper tube 172 and the lower tube 180 respectively are in fluid communication with an internal cavity 128 of the header 126. Also, the upper tube 172 and the lower tube 180 are in fluid communication with each other via the upper joint 176, the first vertical tube 178, and the lower joint 182. The first vertical tube 178 preferably is at least partially translucent or transparent, so that the contents thereof are viewable. Because of the fluid communication of the bypass assembly 170 at its upper and lower ends with the internal cavity 128, and because the first vertical tube is generally parallel with the header 126, if any oil is present in the header 126, then oil (to substantially the same extent) is also present in the vertical tube 178. Also, because the first vertical tube 178 is substantially translucent or transparent, the amount of oil present in the header 126 was observable.

In FIG. 9, an oil level 190 is shown in the first vertical tube 178 which results when the bypass assembly 170 is mounted onto the header 126 of the prior art—that is, a header in a direct expansion evaporator which does not include the extraction apparatus of the invention. In these circumstances, oil is observable, and the oil level 190 is at approximately the same vertical location as a lowermost inner surface 192 of the suction tube. This shows that oil had accumulated in the bottom portion of the header 126, and suggests as a working hypothesis that the somewhat decreased performance of the prior art direct expansion evaporator shown by the data in FIG. 1 was due to the accumulation of oil in the header.

FIGS. 10 and 11 show the bypass assembly 170 mounted on a header 226 with an extraction apparatus 238 positioned partially in the header 226. As can be seen in FIG. 10, when the direct expansion evaporator operates with the extraction apparatus 238 in place, the fluid mixture shown in the first vertical tube 178 is at a level 194 which tends to be level with (or somewhat lower than) the lowermost end 131 of the header 226. In use, once the extraction apparatus 238 was functioning, the level of the fluid mixture of liquid refrigerant and oil in the tube 178 was observed to drop relatively rapidly. This shows that the extraction apparatus 238 succeeds in eliminating the accumulated oil (and liquid refrigerant associated therewith, if any) from the header 226.

Figure 2:
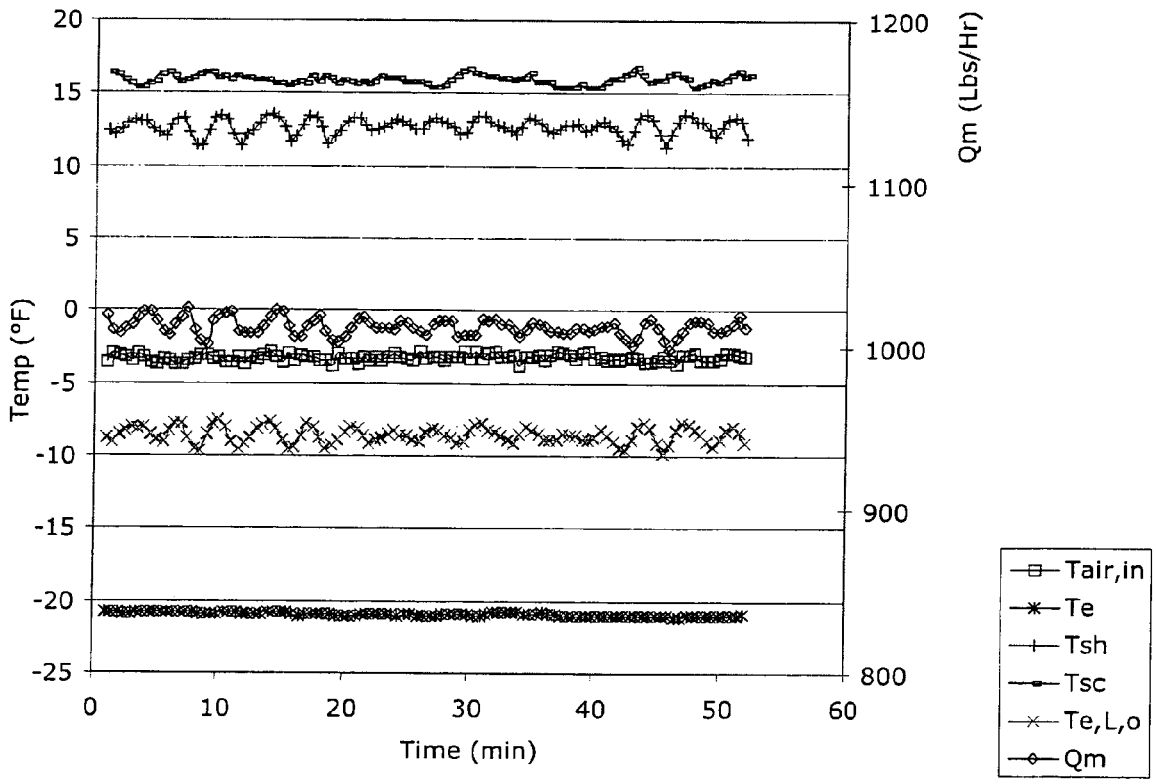
FIG. 2 is a graph showing sample test data relating to the operation of an embodiment of a direct expansion evaporator of the invention.
Figure 3:
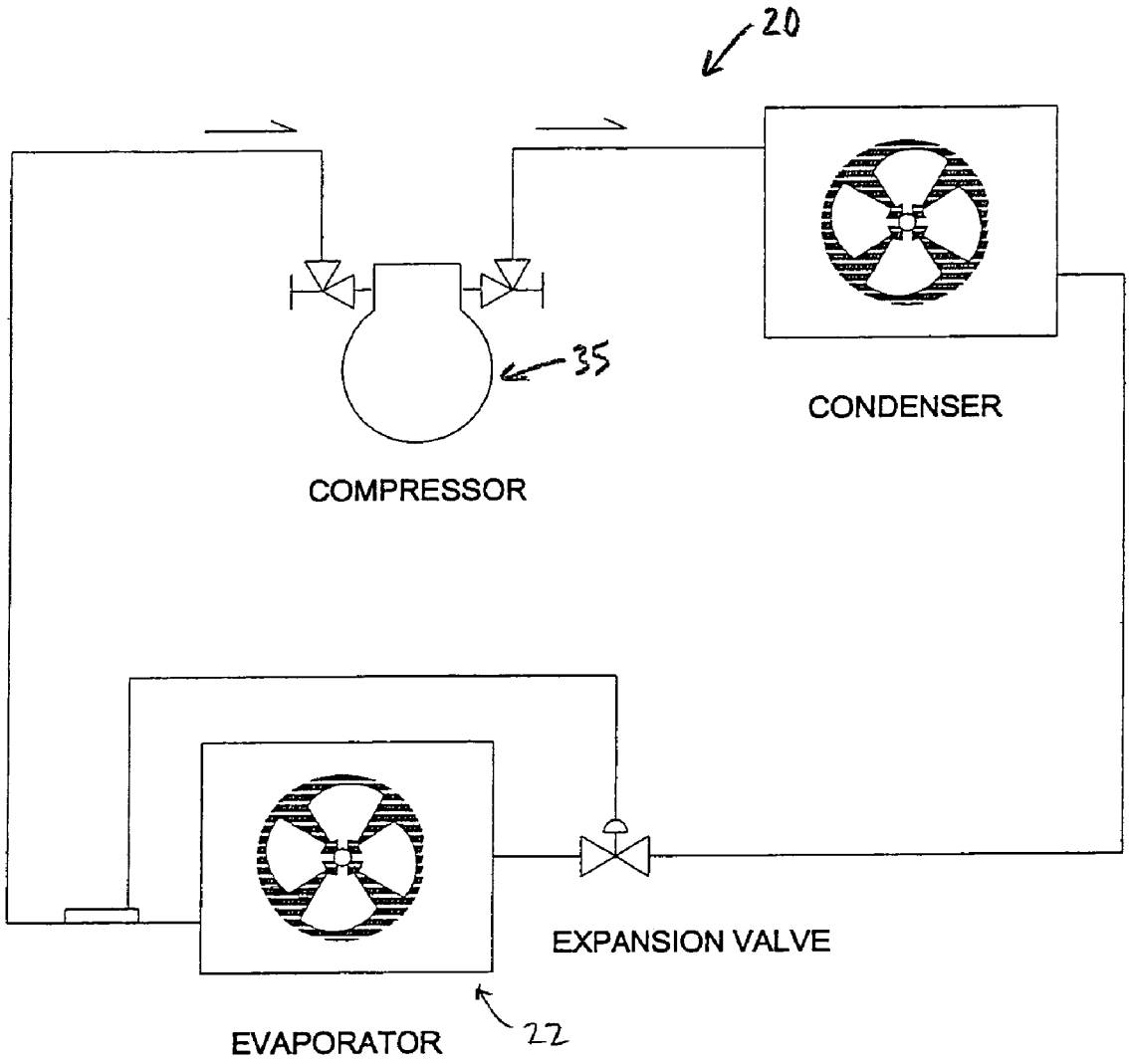
FIG. 3 is a schematic diagram showing the major components of a refrigeration system of the invention.

Consistent with FIG. 10, FIG. 2 shows improved performance resulting from the extraction tube apparatus being mounted on a header and a suction tube. FIG. 2 shows the trend of the evaporator operation with similar (as compared to the data shown in FIG. 1) refrigerant liquid pressure (Pliq), liquid sub-cooling (Tsc), thermal expansion valve setting and room air temperature (Tair, in). As compared to the data shown in FIG. 1, the refrigerant temperature at the outlet of the bottom feed (Te, L, o) has become substantially more stable, and as was evaporator superheat (Tsh), slightly raising evaporating temperature (Te) and system mass flow (Qm). As set out below in Table I, it is estimated that the enhanced refrigeration capacity was approximately 6% for the direct expansion evaporator which was tested, i.e., when the performance of the direct expansion evaporator operated without the extraction apparatus is compared to the performance of the direct expansion evaporator when operated with the extraction apparatus.

TABLE I

Capacity Calculation

| Parameter | | W/o Oil Pick-up Tube | W/Oil Pick-up Tube |
|---|---|---|---|
| Air Entering Temp | ° F. | −3.1 | −3.2 |
| Evaporating Temp | ° F. | −22.0 | −20.9 |
| Evaporator Superheat | ° F. | 12.1 | 12.7 |
| Evaporator T.D | ° F. | 18.9 | 17.7 |
| Refrigerant Mass Flow | Lb/Hr | 993 | 1012 |
| Refrigerant Enthalpy, Entering | Btu/Lb | 42.0 | 43.5 |
| Refrigerant Enthalpy, Leaving | Btu/Lb | 90.4 | 90.6 |
| Capacity at Tested Condition | Btu/Hr | 48060 | 47750 |
| Capacity at 10° F. T.D. | Btu/Hr | 25360 | 27000 |
| Capacity Increase w/ the tube | % | = (27000 − 25360)/25360 × 100 = 6.5% | |

Preferably, and as shown in FIG. 8, the downstream end 46 is substantially coaxial with the suction tube 36. Also, the extraction apparatus 38 preferably is a tube which includes the passage 42. Preferably, the passage 42 is substantially round and cross-sectioned.

In use, a tube with an inner diameter of from 0.19 to 0.26 inches (4.9 to 6.5 millimeters) was found to work well as the extraction apparatus 38 in relatively typical operating conditions described below. For example, in connection with the direct expansion evaporator in which the extraction apparatus 38 was mounted, the stream of the first fluid mixture flows at a rate of between about 900 lbs. per hour and about 1,100 lbs. per hour through a suction tube having an inner diameter of approximately 1.5 inches (38 mm). The length of the passage is preferably between about 4 inches and about 8 inches (about 100 millimeters to about 200 millimeters).

The foregoing examples are provided so that those of ordinary skill in the art may have a complete disclosure and description of how the present invention is practised, and associated processes and methods are used and evaluated. The foregoing examples are intended to be purely exemplary of the invention and are not intended to limit the scope of what the inventors regard as their invention. For instance, it will be appreciated by those skilled in the art that the flow of the fluid mixture through the suction tube may be between approximately 500 lbs./hour and approximately 5,000 lbs./hour, depending on, among other things, the inner diameter of the suction tube.

It will be understood that references herein to "a refrigerant" or "the refrigerant" will be deemed to include a simple refrigerant or a mixture of refrigerants, as is known in the art.

Unless explicitly stated, the method embodiments described herein are not constrained to a particular order or sequence. Additionally, some of the described method embodiments are elements thereof can occur or be performed at the same point in time.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

I claim:

1. A direct expansion evaporator for facilitating evaporation of a refrigerant moved in a circuit through the evaporator to a compressor through a suction tube, the compressor drawing a first fluid mixture of a refrigerant and a lubrication oil through the suction tube in a first direction, said first fluid mixture exerting a first fluid pressure in a second direction opposite to the first direction, the direct expansion evaporator comprising:

a plurality of evaporator tubes, each said evaporator tube providing a conduit for the first fluid mixture;

an elongate header comprising a substantially vertical pipe having an internal cavity extending upwardly from a bottom end thereof;

each said evaporator tube intersecting said header at a predetermined location along the header;

the internal cavity including a bottom portion located at the bottom end of the header in which a second fluid mixture accumulates, said second fluid mixture being substantially static and subject to a second fluid pressure, said second fluid mixture comprising the refrigerant and the lubrication oil, the second fluid pressure being substantially greater than the first fluid pressure;

an extraction apparatus comprising:

a body defining a passage therein extending between an upstream end thereof and a downstream end thereof;

the downstream end being positioned in the suction tube and at least partially immersed in the stream of said first fluid mixture; and the upstream end being positioned in the bottom portion of the internal cavity and at least partially immersed in said second fluid mixture;

the downstream end being positioned to subject the passage at the downstream end to the first fluid pressure such that a pressure differential between said first fluid mixture and said second fluid mixture is provided which draws said second fluid mixture through the passage and into the stream.

2. A direct expansion evaporator according to claim 1 in which the body comprises a downstream end portion terminating at the downstream end and positioned to direct said second fluid mixture substantially in the first direction.

3. A direct expansion evaporator according to claim 2 in which the downstream end portion is substantially in the form of a right circular cylinder, with the downstream end defining a base of said cylinder.

4. A refrigeration system comprising:

a direct expansion evaporator comprising:

a plurality of evaporator tubes, each said evaporator tube providing a conduit for a fluid mixture comprising a refrigerant and lubrication oil;

an elongate header comprising an internal cavity extending upwardly from a bottom end thereof;

each said evaporator tube intersecting said header;

the internal cavity including a bottom portion located at the bottom end of the header in which a second fluid mixture accumulates, said second fluid mixture being substantially static and subject to a second fluid pressure, said second fluid mixture comprising refrigerant and lubrication oil;

a compressor for compressing said refrigerant;

a suction tube in fluid communication with the header and the compressor through which a stream of a first fluid mixture comprising refrigerant and oil is drawn substantially in a first direction from the header by the compressor, said first fluid mixture in the stream exerting a first fluid pressure in a second direction substantially opposite to the first direction;

an extraction apparatus comprising:

a body defining a passage therein extending between an upstream end thereof having an upstream hole and a downstream end thereof having a downstream hole, the downstream and upstream holes being in fluid communication through the passage;

the downstream end being positioned in the suction tube and the upstream end being positioned in the bottom portion of the internal cavity and at least partially immersed in said second fluid mixture; and the downstream end being positioned to direct the second fluid mixture exiting therefrom substantially in the first direction, providing a pressure differential which draws said second fluid mixture through the passage and into the suction tube.

5. A refrigeration system according to claim 4 in which the downstream end of the extraction apparatus is substantially coaxial with the suction tube.

6. A refrigeration system according to claim 4 in which the extraction apparatus comprises a tube comprising the passage.

7. A refrigeration system according to claim 6 in which the passage is substantially round in cross-section.

8. A refrigeration system according to claim 7 in which the passage has a diameter of between approximately 0.19 inches and approximately 0.26 inches.

9. A refrigeration system according to claim 6 in which the passage is between approximately four inches and approximately eight inches in length.

10. An extraction apparatus for enabling a substantially static second fluid mixture positioned in a bottom portion of a header of a direct expansion evaporator and subject to a second fluid pressure to be extracted from the header and directed into a stream of a first fluid mixture drawn through a suction tube substantially in a first direction to a compressor from the header, the first fluid mixture exerting a first fluid pressure in a second direction substantially opposite to the first direction which is substantially less than the second fluid pressure to create a pressure differential therebetween, the extraction apparatus comprising:

a body defining a passage therein extending between an upstream end and a downstream end thereof;

the downstream end being positioned in the suction tube and at least partially immersed in the stream of said first fluid mixture;

the upstream end being positioned in the bottom portion and at least partially immersed in said second fluid mixture;

the downstream end being positioned to expose the passage at the downstream end to the first fluid pressure such that said second fluid mixture is drawn by the pressure differential into the passage at the upstream end and discharged from the passage at the downstream end.

11. An extraction apparatus according to claim 10 in which the body comprises a downstream end portion terminating at the downstream end and positioned to channel said second fluid mixture substantially in the first direction.

12. An extraction apparatus according to claim 11 in which the downstream end portion is substantially in the form of a right circular cylinder, with the downstream end defining a base of said cylinder.

13. An extraction apparatus according to claim 11 in which the downstream end of the body defines a plane positioned substantially orthogonal to the predetermined direction of the stream of said first fluid mixture.

14. An extraction apparatus according to claim 11 in which the downstream end portion is substantially coaxial with the suction tube.

15. An extraction apparatus according to claim 10 in which the stream of said first fluid mixture flows at a rate of between about 500 lbs./hour and about 5,000 lbs./hour.

16. A method of moving a substantially static fluid mixture which is positioned in a bottom portion of a header in a direct expansion evaporator and subject to a second fluid pressure into a dynamic fluid mixture moving in a first direction in a stream through a suction tube from the direct expansion evaporator to a compressor, the dynamic fluid mixture exerting a first fluid pressure substantially in a second direction opposite to the first direction, the second fluid pressure being substantially greater than the first fluid pressure, the method comprising the steps of:

(a) providing an extraction apparatus comprising a body defining a passage extending therethrough between an upstream end and a downstream end thereof;

(b) positioning the upstream end of the passage at least partially in the substantially static fluid mixture; and (c) positioning the downstream end of the passage at least partially in the stream of the dynamic fluid mixture to expose the passage at the downstream end to the first fluid pressure for creating a pressure differential between the first and second fluid pressures which draws the substantially static fluid mixture through the passage and into the stream of the dynamic fluid mixture.

17. A refrigeration system comprising:

a direct expansion evaporator through which a fluid mixture of a refrigerant and oil is pumped, the evaporator comprising a substantially vertical header;

a compressor for compressing the refrigerant;

a suction tube in fluid communication with the header and the compressor through which a stream of a first fluid mixture comprising refrigerant and oil is drawn substantially in a first direction from the header by the compressor, the first fluid mixture exerting a first fluid pressure in a second direction substantially opposite to the first direction;

the header comprising a bottom end thereof in which a second fluid mixture comprising refrigerant and oil accumulates, said second fluid mixture being subject to a second fluid pressure;

an extraction apparatus comprising:

a body defining a passage therein extending between an upstream end thereof with an upstream hole and a downstream end thereof with a downstream hole, the downstream and upstream holes being in fluid communication through the passage;

the downstream end being positioned in the suction tube and the upstream end being positioned in the header and at least partially immersed in said second fluid mixture, such that the passage is subject to said second fluid pressure at the upstream end; and the passage at the downstream end being at least partially exposed to the first fluid pressure to provide a pressure differential through the passage between the upstream end and the downstream end for drawing the second fluid mixture through the passage for discharge at the downstream end into the suction tube.

* * * * *